US010265247B1

(12) United States Patent
Sidi

(10) Patent No.: US 10,265,247 B1
(45) Date of Patent: Apr. 23, 2019

(54) ACCESSORY FOR USE WITH A BOTTLE CONTAINING MEDICATION IN THE FORM OF PILLS

(71) Applicant: Yazid Ould Sidi, Canoga Park, CA (US)

(72) Inventor: Yazid Ould Sidi, Canoga Park, CA (US)

( * ) Notice: Subject to any disclaimer, the term of this patent is extended or adjusted under 35 U.S.C. 154(b) by 0 days.

(21) Appl. No.: 15/593,125

(22) Filed: May 11, 2017

(51) Int. Cl.
*A61J 7/04* (2006.01)
*A61J 1/03* (2006.01)
*G08B 21/18* (2006.01)

(52) U.S. Cl.
CPC ..... *A61J 7/0481* (2013.01); *A61J 1/03* (2013.01); *A61J 7/0418* (2015.05); *A61J 7/0454* (2015.05); *G08B 21/182* (2013.01)

(58) Field of Classification Search
CPC ..... A61J 7/0481; A61J 7/0418; A61J 7/0454; A61J 1/03; G08B 21/182
USPC ..... 340/540
See application file for complete search history.

(56) References Cited

U.S. PATENT DOCUMENTS 6,271,753 B1 8/2001 Shukla
6,604,650 B2 8/2003 Sagar
7,366,675 B1 * 4/2008 Walker ..... G06F 19/3462 705/2
8,319,613 B2 11/2012 Lazar
8,727,180 B2 5/2014 Zonana et al.
8,754,769 B2 6/2014 Stein et al.
8,963,710 B2 2/2015 Huang et al.
9,842,195 B2 * 12/2017 Hanson ..... G08B 21/24
2007/0016443 A1 1/2007 Wachman et al.
2011/0012742 A1 * 1/2011 Johnson ..... G08B 21/24 340/669
2011/0226651 A1 * 9/2011 Patino ..... A61J 1/03 206/438
2012/0056000 A1 * 3/2012 Shores ..... A61J 7/0418 235/492
2015/0272825 A1 * 10/2015 Lim ..... A61J 1/03 340/5.2
2015/0310186 A1 * 10/2015 Conley ..... G06F 19/3462 700/237
2015/0360834 A1 12/2015 Mikhail
2016/0048657 A1 * 2/2016 LeBrun ..... G06F 19/3462 705/2
2016/0144141 A1 * 5/2016 Biswas ..... A61M 15/009 128/200.23
2017/0035960 A1 * 2/2017 Elder ..... A61M 5/14244
2017/0231870 A1 * 8/2017 Stachler ..... A61J 7/0481 222/28
2017/0270774 A1 * 9/2017 Fateh ..... A45D 40/0068
2017/0323553 A1 * 11/2017 Engelhard ..... G06F 19/00
2017/0337347 A1 * 11/2017 Chu ..... G06F 19/3456

* cited by examiner

*Primary Examiner* — Hirdepal Singh
(74) *Attorney, Agent, or Firm* — Thomas I. Rozsa

(57) ABSTRACT

A pill bottle accessory that provides a pill management system for the storage, dispensing, and tracking of medicine. The pill bottle accessory has features that allow the user or third party to monitor the amount of pills remaining within the medicine bottle and to monitor activity and user defined thresholds for pills and a medicine bottle.

6 Claims, 8 Drawing Sheets

ACCESSORY FOR USE WITH A BOTTLE CONTAINING MEDICATION IN THE FORM OF PILLS

BACKGROUND OF THE INVENTION

1. Field of the Invention

This invention relates to the field of medicine pill bottles. Specifically, this invention relates to the storage of medicine pill bottles and the tracking of medicine contained in the medicine pill bottles.

2. Background of the Invention

According to the National Institutes of Health, in 2010 the cost of health care was estimated at 2.7 trillion dollars, out of which over 20% ($550 billion) is wasteful or due to medication non-adherence. Specifically, studies show that around 180 million Americans use prescription drugs every month. Other studies indicate that 52 million Americans do not adhere to the prescription instructions. Some of the reasons that contribute to patient nonadherence include: forgetting to use the medication on time, forgetting to contact the pharmacy for prescription refills, forgetting to contact the doctor for prescription renewal, Medication overdose, mixing medications, tampering with medication, theft or loss of medications, damage to medications and coordinating medications to be taken together and prevent unsafe mixing of medications.

3. Description of the Prior Art

The following 8 patents and published patent applications are the closest prior art known to the inventor:

1. U.S. Pat. No. 6,271,753 issued to Kavita M. Shukla on Aug. 7, 2001 for "Smart Lid" (hereafter the "Shukla Patent");
2. U.S. Pat. No. 6,604,650 issued to Richard Bryan Sagar on Aug. 12, 2003 for "Bottle-Cap Medication Reminder and Overdose Safeguard" (hereafter the "Sagar Patent");
3. United States Published Patent Application No. 2007/0016443 to Joshua Seth Wachman et al. on Jan. 18, 2007 for "Medication Compliance Systems, Methods and Devices With Configurable and Adaptable Escalation Engine" (hereafter the "Wachman Published Patent Application");
4, U.S. Pat. No. 8,319,613 issued to Steven Lazar on Nov. 27, 2012 for "Smart Cap With Communication Function" (hereafter the "Lazar Patent");
5. U.S. Pat. No. 8,727,180 issued to Moses Zonana et al. on May 20, 2014 for "Smart Cap System" (hereafter the "Zonana Patent");
6. U.S. Pat. No. 8,754,769 issued to Joshua Stein et al. on Jun. 17, 2014 for "Systems and Methods for Determining Container Contents, Locations and Surroundings" (hereafter the "Stein Patent");
7. U.S. Pat. No. 8,963,710 issued to Jiandong Huang et al. on Feb. 24, 2015 for "Systems and Apparatus for Container Conversion" (hereafter the "Huang Patent");
8. United States Published Patent Application No. 2015/0360834 to Tamer S. M. Mikhail on Dec. 17, 2015 for "Pill Bottle Lid Incorporating Audible Messaging Device, and Pairing Thereof with External Devices for Dosage Reminder and Conflict Checking Purposes" (hereafter the "Mikhail Published Patent Application").

The Shukla Patent discloses a container that notifies a user through the use of an alarm that works in conjunction with the bottle. Once the lid is removed the user is notified by a wireless radio transmitter that the lid of the containers has been opened. However, the Shukla Patent only provides an alarm notification if the lid is removed.

The Sagar Patent discloses a container that communicates with an interface to allow a user to schedule alerts with these alerts ceasing when the container has been opened. This Patent discloses a sensor to determine whether the container has been opened. This sensor could be mechanical or by light detection. The Sage Patent also discloses that the interface in this invention notifies the user of the time of the last alert and whether the pill was taken and/or whether the container was opened.

The Wachman Published Patent Application discloses a method and system of aiding medication compliance. This patent publication discloses a container that communicates with an interface to track and compare the prescribed medication plan with actual use or number of times the container is opened and the amount of medication that has actually been removed. This patent publication also discloses a motion sensor to determine whether the container has moved. Also included in this publication is a method for notifying care givers and pharmacies.

The Lazar Patent discloses a container that has a sensor that can scan each pill and verify when pills are being removed from the container. This information can then be transmitted via a short distance transmitter to an electronic device. Also disclosed in this invention is an audio speaker that allows audio messages.

The Zonana Patent discloses a medicine container cap for use with a bottom container that aids in the dispensing of pills from the container. This invention contains a ramp within the cap for the pills to fall down by force of gravity.

The Stein Patent discloses a pill system to determine whether or not patients are taking their prescribed pills. The present invention is a more comprehensive pill management system which includes features not disclosed in this prior art.

The Huang Patent discloses an apparatus for converting a container into a smart bottle.

The Mikhail Published Patent Application discloses a pill bottle cap that is designed to incorporate digital messaging with electronic devices, sound and alert notifications to remind a user to take medication. The pill bottle cap has a computer device that cross checks the user's medication with the user's known allergies.

Therefore, there is a substantial need for an improved accessory that allows a user or the user's relative, emergency contact. doctor and/or other caregiver to monitor the user's medication adherence.

SUMMARY OF THE INVENTION

The present invention is a pill bottle accessory that provides a pill management system for the storage, dispensing, and tracking of medicine. The present invention pill bottle accessory has features that allow the user or third party to monitor the amount of pills remaining within the medicine bottle and to monitor activity of the medicine bottle.

It is an object of the present invention to have a wireless transceiver that allows connection to the internet.

It is also an object of the present invention to have a microcontroller to interface with the electronic and mechanical sensors to compute and control the status of the container.

The innovation includes a holding member into which a medicine bottle is placed or onto which a medicine bottle is placed.

It is an additional object of the present invention to have a microcontroller to performs the following tasks: 1) keep track of time and medication schedule; 2) create a signal by an LED light to blink or sound an alarm when medication is scheduled to be taken; 3) receive current time information and compare it with the schedule; 4) receive current storage environmental condition information such as temperature and humidity of the medicine bottle; 5) compute the number of pills remaining in the medicine bottle by use of a load cell; 6) notify the user or third party via phone or other electronic device of unexpected motion of the pill bottle; 7) detect opening or closing of the pill bottle; 8) monitor the battery level and notify the user when the device battery needs to be changed; 9) store history and critical data in a nonvolatile EEPROM memory; and 10) allow firmware upgrade and history download wirelessly; 11) send signal strength indication for device localization; 12) activate a different set of LED lights when the usage was inappropriate or when the bottle is not properly closed and stored; 13) sends alerts and notification when the pill count is low; and 15) control the wireless data transfer encryption mechanism such as a 128 bit Advanced Encryption System (AES).

It is an additional object of the present invention to incorporate software that provides a notification that certain foods should not be taken with certain medications because an adverse reaction will result or neutralize the medication. The software also advises if certain medications should not be taken with each other or if medications need to be taken with food or at bedtime or other requirements.

The present invention pill bottle accessory can also be updated by a mobile device or computer or other standard electronic device to alert the user when the pills should be taken, the time the pills were placed in the bottle (to notify the user how old the pills are).

The following discussion applies to the following two separate variations of the present invention:

1. The first variation is incorporated into a holding member such as base (sometimes referred to as a "snap-on") into which a standard medicine bottle is placed. It is also within the spirit and scope of the present invention to have different bases with different sized or shaped holding members to accommodate medicine bottles of different sizes and shapes. The innovative members are incorporated into the snap-on.

2. In the second variation, the innovative members of the present invention are incorporated directly into the medicine pill bottle.

Externally, the medication bottle looks similar to normal medication containers except that it contains a small window where blinking LEDs are visible to notify the user when it is time to use the medication. The LEDs also help identify which medication is due for usage in case the user has a multiple medication container. An embedded buzzer also helps visually impaired user to locate the medicine pill bottle.

It is an additional object of the present invention to provide a bottle or bottle holder that is composed of:

1. An isolated area where the medication is stored. This area is biocompatible to ensure that the medication is not contaminated by the environment or by the bottle material or other chemicals used in the electronic system such as battery and/or printed circuit board (PCB) material. In addition to the printed circuit board, the components of the printed circuit board including electronic chips and other electronic components are specifically selected so as not to contaminate the medication.

2. A mechanism to detect when the bottle is opened or closed. The mechanism employs one of the following implementations: a spring load, an electric switch, a hall/magnetic sensor, or an opto interrupter.

3. A mechanism to detect the number of pills included in the bottle. The mechanism can be a miniature high precision load cell, strain gauge or force sensor that is used as a base for a weight scale to count how many pills are left in the bottle and therefore, how many pills have already been consumed.

4. A sealed compartment for the printed circuit board (PCB);

5. A transparent area to provide LED colored lights visibility to alert the user about the status of the medication;

6. An optional mechanism for fingerprint sensing to determine if the person who opens the bottle and takes the medication is the authorized user or if it is being tampered with by someone who is not authorized to be opening the bottle.

7. An optional mechanism for locking and unlocking the bottle; and

8. A keypad for passcode entry.

It is a further object of the present invention to provide a PCB which is inserted into an isolated compartment inside the medication container to provide internet connectivity and to support a large number of sensors including the following:

1. A wireless transceiver that allows internet connectivity with cellular, bluetooth, or other standard means. At this stage, the wireless transceiver is based on a Bluetooth Low Energy (BLE) standard to communicate the state of the bottle with other wireless subsystems such as a smart phone (Apple iOS and Android and Windows), or a tablet, and other smart devices such as a Smart Watch, Smart Glasses (Google glass), smart television sets, or similar devices.

2. A microprocessor that interfaces with the electronic and mechanical sensors to compute and control the status of the bottle and to perform the following tasks: keep track of time and medication schedule; compute the number of pills taken and the number of pills left in the bottle; compute the storage environmental conditions such as temperature and humidity; activate notification and alerts about unexpected motion and tampering; activate a set of LED lights and a buzzer when it is time to use the medication; activate a different set of LED lights when the usage was inappropriate or when the bottle is not properly closed and stored; detect opening and closure of the bottle; send alerts, alarms and notifications; control the wireless data transfer encryption mechanism, speed and schedule; send signal strength indication for device localization; monitor the battery level and notify the user when the device battery needs to be changed; store history and critical data in a nonvolatile EEPROM memory and enable an 128 bit AES encryption mechanism.

3. A sensor mechanism and corresponding electronic circuitry to identify how many pills remain in the bottle. This functionality allows tracking of the medication usage history to prevent overdosing, under-dosing, medication mixing and unauthorized or unexpected use.

4. A sensor mechanism and corresponding electronic circuitry to detect when the bottle is opened or closed. This functionality tracks the time when the medication is accessed and also helps prevent unauthorized users from tampering with the mechanism.

5. A sensor mechanism and corresponding electronic circuitry to detect motion or vibration. This is a safety mechanism to prevent tampering and unauthorized access. For example: the user is notified when a child, pet, visitor or unauthorized person shakes or moves the medication from its location.

6. A sensor mechanism and corresponding electronic circuitry to measure the storage condition of the medication by performing temperature and humidity measurement, thereby preventing damage of the medication. The sensor is functional within the full −40° C. to +125° C. temperature range.

7. A sensor mechanism and corresponding electronic circuitry to provide visual notification (LED light) when it is time to take the medication and/or when the medication container is not properly stored. This functionality will also help the user with multiple medications to quickly identify which one to take.

8. A sensor mechanism and corresponding electronic circuitry to provide audible notification (buzzer) when it is time to take the medication and/or when the medication container is not properly stored. This functionality helps notify the visually impaired when it is time to use their medication.

9. A sensor mechanism and corresponding electronic circuitry to provide device battery monitoring.

10. A sensor mechanism and corresponding electronic circuitry to send wireless messages to smart phones, tablets and internet using Bluetooth, Bluetooth low energy, Wi-Fi, and/or cellular to notify the user and when appropriate, the relative, doctor and/or the authorities of unexpected use.

11. A sensor mechanism and corresponding electronic circuitry that allows fingerprint identification and bottle lock/unlock actuation.

12. A nonvolatile memory for history and critical data storage.

It is an additional object of the present invention to improve the manner in which patients who are prescribed medication take their medication. This includes improving a patient's adherence to the taking of the medication by reminding the patient to take the medication, reminding the patient to refill the medication, and notifying the doctor that a prescription renewal is needed.

It is a further object of the present invention to provide a pill management system that helps prevent under dosage of medication, over dosage of medication, mixing of medication, theft of medication, and unsafe storage causing damage to medication.

It is still a further object of the present invention to provide a low cost, safe and secure medication container that has an embedded electronic circuit board that provides a connection to the internet and offers a number of sensors that allow real time monitoring of the medication usage and access.

It is a further object of the present invention to provide a database securely accessible by authorized parties that includes a history of records of every patient. The database includes multiple tables such as: table for medications, table for clients, table for cell phones, table for notifications, Graphs (Histograms, Distributions), smart algorithms for data mining, and medication active components and alarms when there is a dangerous mix.

It is still a further object of the present invention to provide connection to Apple iPhones and tablets as well as Android devices via a mobile application (App). Each App includes a profile for each sensor and provides a graphical user interface (GUI) that connects with the present invention pill bottle accessory. In addition, the App can enable/disable, configure and display sensor data. The App also has a feature which allows authorized users to access the medication account from anywhere in the world. Example of the functionalities include:

1. Client setup to set up permissions as to who has access to the account which could include: Admin (patient or Guardian), relative (loved ones), Authorized Monitor (Doctor, Pharmacy, Insurance, Government, or Information Technology services);

2. Setting up limits and thresholds which may include: medication schedule, allowed temperature and humidity, and motion type;

3. Setup Notification which may include: SMS Text messaging, Buzzer, LED Lights, Phone Call, Email, Configuration of remote notifications, alerts and alarms for other parties (relative, doctor, authorities, or similar authorized user) by use of SMS Text messaging, Phone Call, or Email;

4. Configuration of remote notifications to the pharmacy about refills by use of Phone Call, Email, or Web services;

5. Configuration of remote notifications to the doctor about medication renewal by use of Phone Call, Email, or Web services;

6. Sending statistical reports at daily and/or weekly intervals;

7. Notification, Alert or Alarm about Under dose (Calendar, Pill Count Monitor);

8. Notification, Alert or Alarm about Misuse;

9. Notification, Alert or Alarm about Unauthorized access (Unexpected change of pill count, Unexpected and prolonged motion, unexpected opening of the bottle;

10. Notification, Alert or Alarm about Motion/Theft (Unexpected change of pill count, Unexpected and prolonged motion, unexpected opening of the bottle);

11. Notification, Alert or Alarm about Location (Signal Strength, Out of range);

12. Notification, Alert or Alarm about Battery Status;

13. Notification, Alert or Alarm about Storage Conditions (Temperature and Humidity);

14. Alarm when more than one medication cannot be mixed at the same time and

Coordinating medications to be used safely together or providing an alarm to notify when foods should not be taken with certain medications.

15. History and trace download; and

16. Firmware upgrade.

It is still a further object of the present invention to provide a digital display of a medication that is viewed as a digital label that includes relevant information regarding the medication.

It is also within the spirit and scope of the present invention to work in conjunction with multiple medicine bottles. These medicine bottles can be stored on a tray or carousel having a multitude of openings or slots that each medicine bottle would rests upon. Underneath each one of these openings or slots is at least a strain gauge, but each opening can have a pill management system associated with it.

It is also within the spirit and scope of the present invention to have a biometric sensor that works in conjunction with a fingerprint sensor to open and close a container that stores medication. In addition, the present invention may be programmed into a robot which will perform the function as set forth above and deliver the medicine to the person in the correct amount or quantity.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
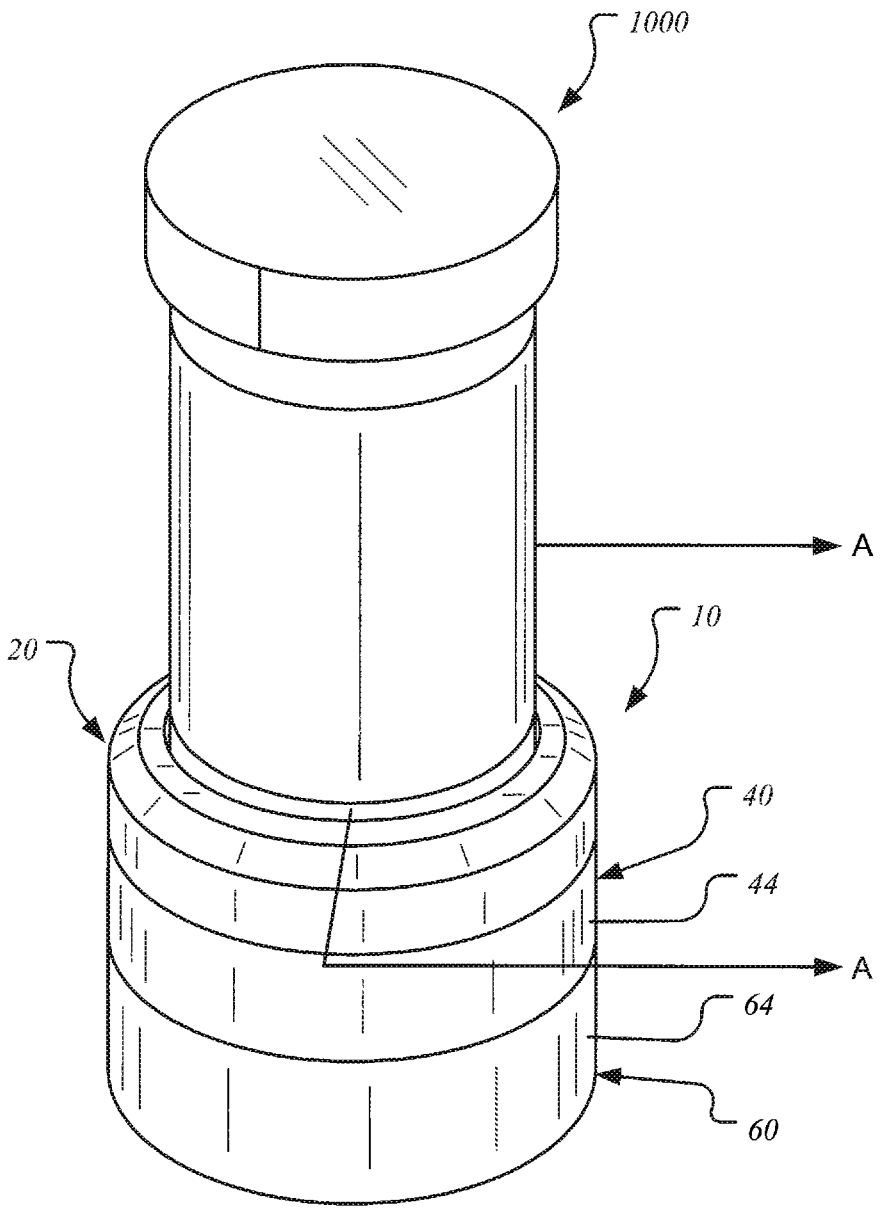
FIG. 1 is a front perspective view of the present invention medicine bottle accessory located inside of the snap-on embodiment with a medicine bottle temporarily affixed to the snap-on embodiment.

Referring to FIG. 1, there is illustrated the snap-on embodiment 10 temporarily affixed to a standard medicine bottle 1000. Snap-on embodiment 10 has a disposable upper section 20, a middle cylindrical section 40, and a lower cylindrical section 60. Located within, but not directly viewable within FIG. 1, is the present invention pill bottle accessory 100 (illustrated in FIGS. 2 and 3 in the snap-on embodiment). Also illustrated is disposable upper section 20 having an upper outer circumferential surface 24 (see FIG. 2), middle cylindrical section 40 having a middle first outer circumferential surface 44, and lower cylindrical section 60 having a lower outer circumferential surface 64.

Figure 2:
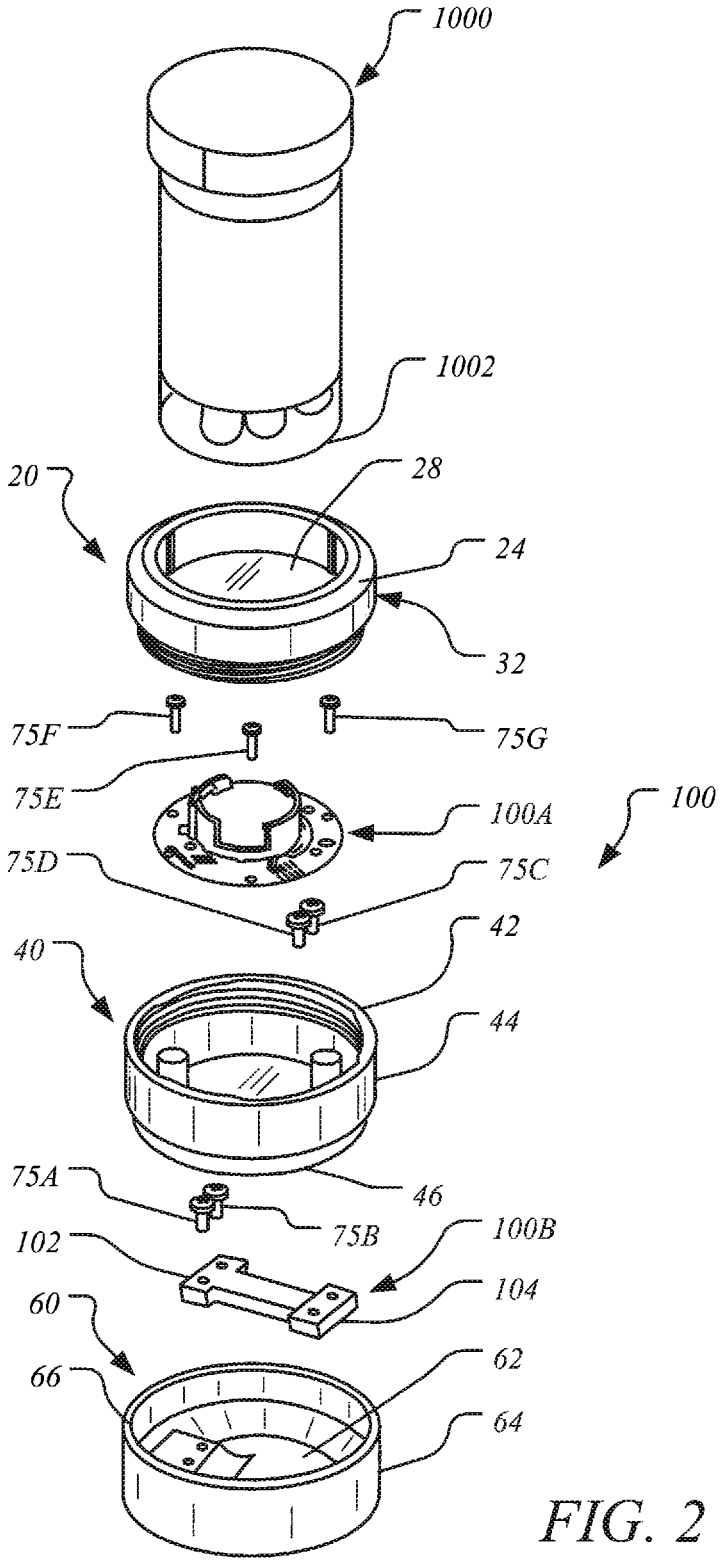
FIG. 2 is an exploded view of the present invention medicine bottle accessory located inside of the snap-on embodiment.

Referring to FIG. 2, there is illustrated an exploded view of the snap-on embodiment 10 having a medicine bottle 1000 with a medicine bottle bottom 1002 that will affix to an upper first top surface 22 (see FIG. 3) of disposable upper section 20. Internal to snap-on embodiment 10 is present invention pill bottle accessory 100 which is comprised of printed circuit board (PCB) section 100A and strain gauge section 100B, with PCB section 100A having a humidity sensor, a temperature sensor and a motion detection sensor.

Further illustrated in FIG. 2 is middle cylindrical section 40 having a middle interlocking section 42, a middle first outer circumferential surface 44 and a middle second outer circumferential surface 46.

Referring to FIG. 2, one of the components that comprises the present invention pill bottle accessory 100 is strain gauge 100B. Strain gauge left portion 102 is affixed to lower top surface 62 of lower cylindrical section 60 by screws 75A and 75B. Middle cylindrical section 40 is affixed to strain gauge right portion 104 by screws 75C and 75D.

Still referring to FIG. 2, PCB section 100A is illustrated being affixed to middle cylindrical section 40 by screws 75E, 75F, and 75G.

Figure 3:
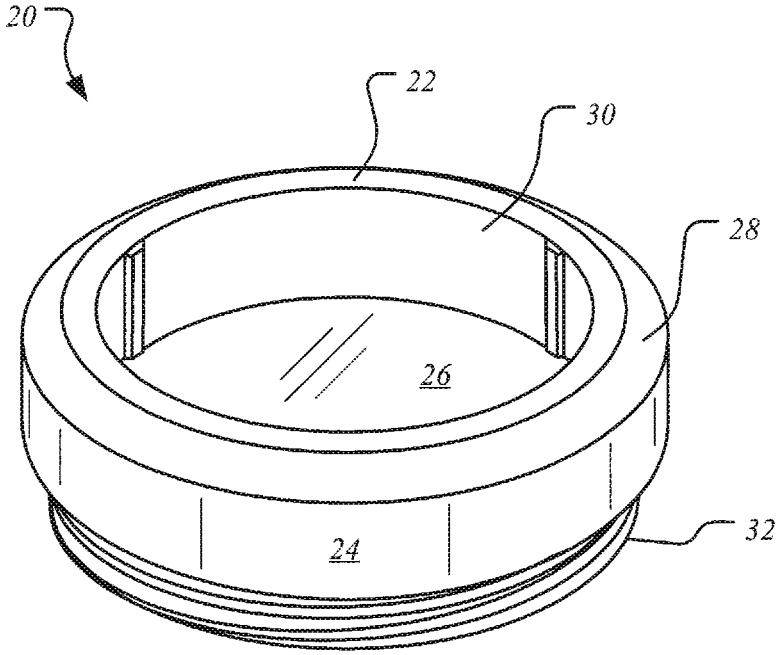
FIG. 3 is a front perspective view of the disposable portion of the snap-on embodiment.
Figure 4:
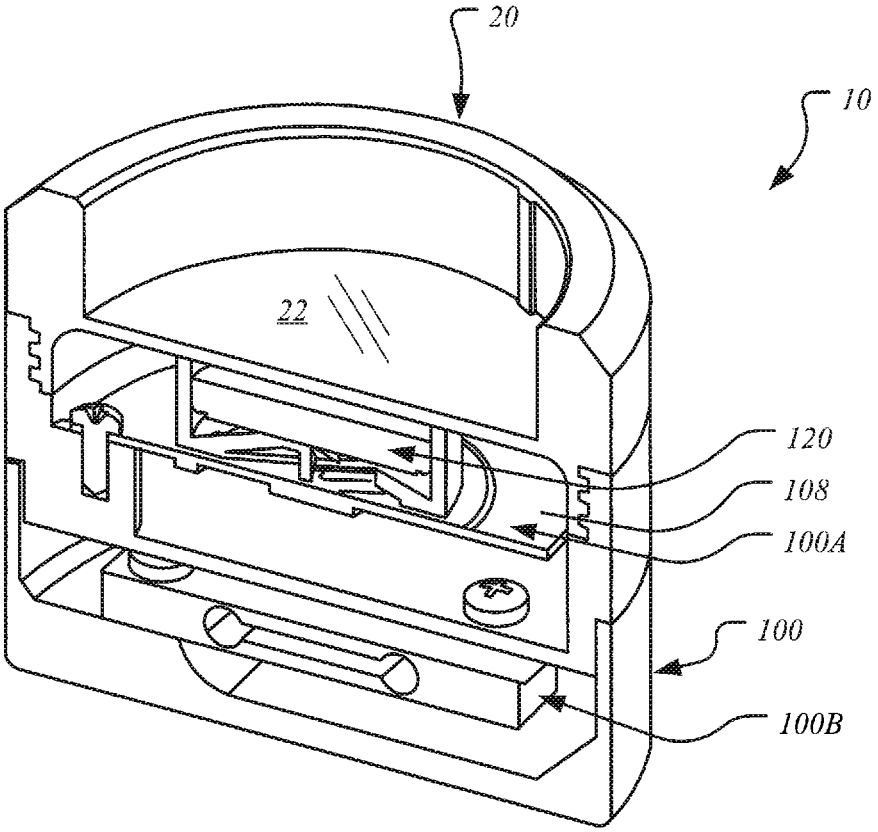
FIG. 4 is a cross-sectional view taken along section A-A in FIG. 1 of the present invention medicine bottle accessory located inside of the snap-on embodiment.

Referring to FIGS. 2, 3, and 4, disposable upper section 20 has an upper first top surface 22, a cylindrical surface 26, an upper outer circumferential surface 24, an upper transitional surface 28, an upper inner surface 30, and a lower interlocking section 32. Disposable upper section 20 can be removed and replaced with a multitude of different sized and shaped upper sections that fit with standard pill bottles or medicine bottles to allow snap-on embodiment 10 to be temporarily affixed to the pill bottle. Disposable upper section 20 affixes to middle cylindrical section 40 by means of an interlocking section 32 on upper section 20 and middle interlocking section 42. This connection can be via interlocking threads, tongue and grove sections, or other standard affixation means. Similarly, middle cylindrical section 40 affixes to lower cylindrical section 60 via interlocking threads, tongue and grove sections, or other standard affixation means.

Referring to FIG. 4, there is illustrated a cross-sectional view of the snap-on embodiment 10 taken along section line A-A of FIG. 1 exposing the present invention pill bottle accessory 100 which is comprised of printed circuit board (PCB) section 100A and strain gauge section 100B. Positioned in the center and fastened on the top of PCB surface 108 is microcontroller 120. Microcontroller 120 receives sensor feedback from mechanical sensors and electronic sensors located on PCB section 100B for temperature, humidity, and motion and sensor feedback information can be transmitted via a transceiver to external devices.

Figure 5:
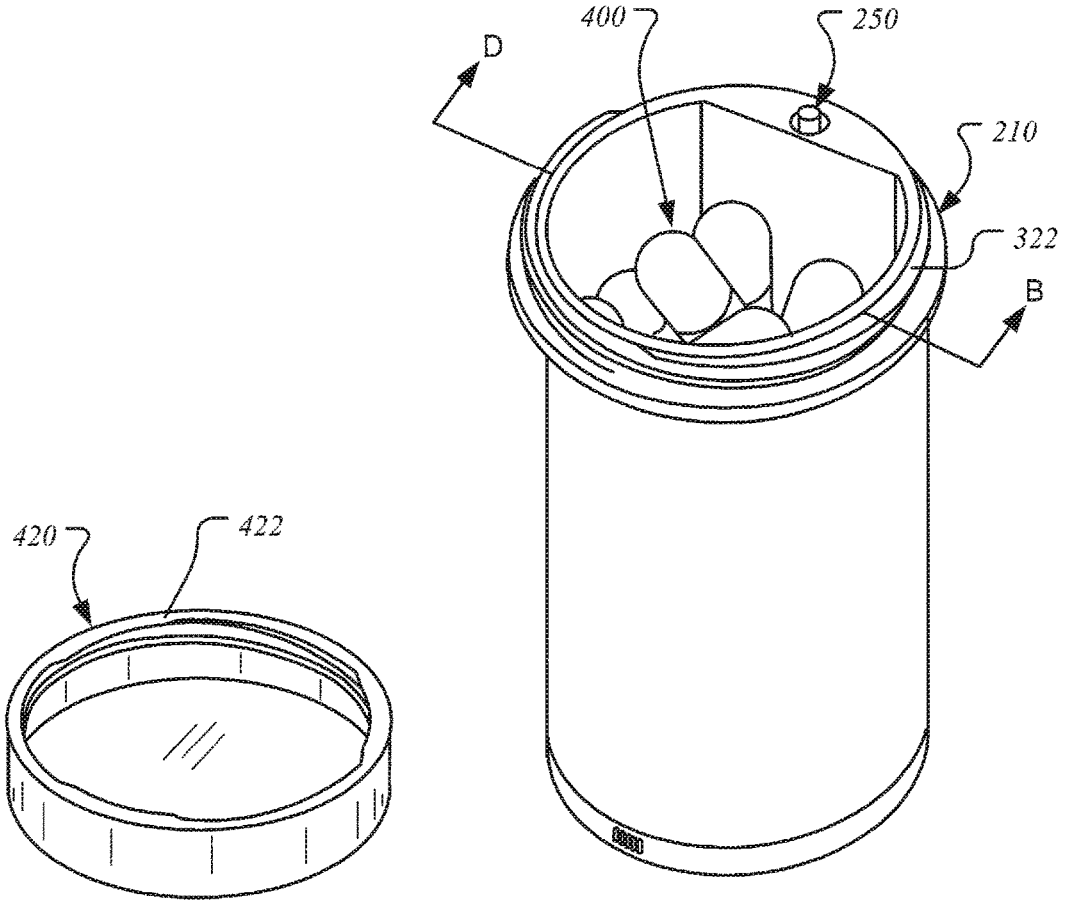
FIG. 5 is a front perspective view of the present invention medicine bottle accessory located inside of the medicine bottle embodiment with the lid of the bottle removed.

Referring to FIG. 5, there is illustrated a second embodiment medicine bottle 210 having the present invention pill bottle accessory 100. Located within, but not directly viewable within FIG. 5, is the present invention pill bottle accessory 100 (illustrated in FIG. 6). Referring to FIG. 5, there is further illustrated a medicine bottle lid 420 having a lid interlocking member 422 that is used to temporarily affix medicine bottle lid 420 to bottle top interlocking member 322 of second embodiment medicine bottle 210. This connection can be via interlocking threads, tongue and grove sections, or other standard affixation means.

FIG. 5 also shows a multitude of pills 400 located within second embodiment medicine bottle 210. When medicine bottle lid 420 is removed from the top of second embodiment medicine bottle 210, bottle sensor 250 sends an open bottle signal to microcontroller 120. Similar to the snap-on embodiment, the microcontroller 120 located inside of second embodiment medicine bottle 210 receives sensor feedback from mechanical sensors and electronic sensors located on PCB section 100B for temperature, humidity, and motion. In addition, as stated above the medication bottle has a bottle sensor 250 so that the snap-on embodiment does not have to detect the opening and closing of medicine bottle lid 420.

Figure 6:
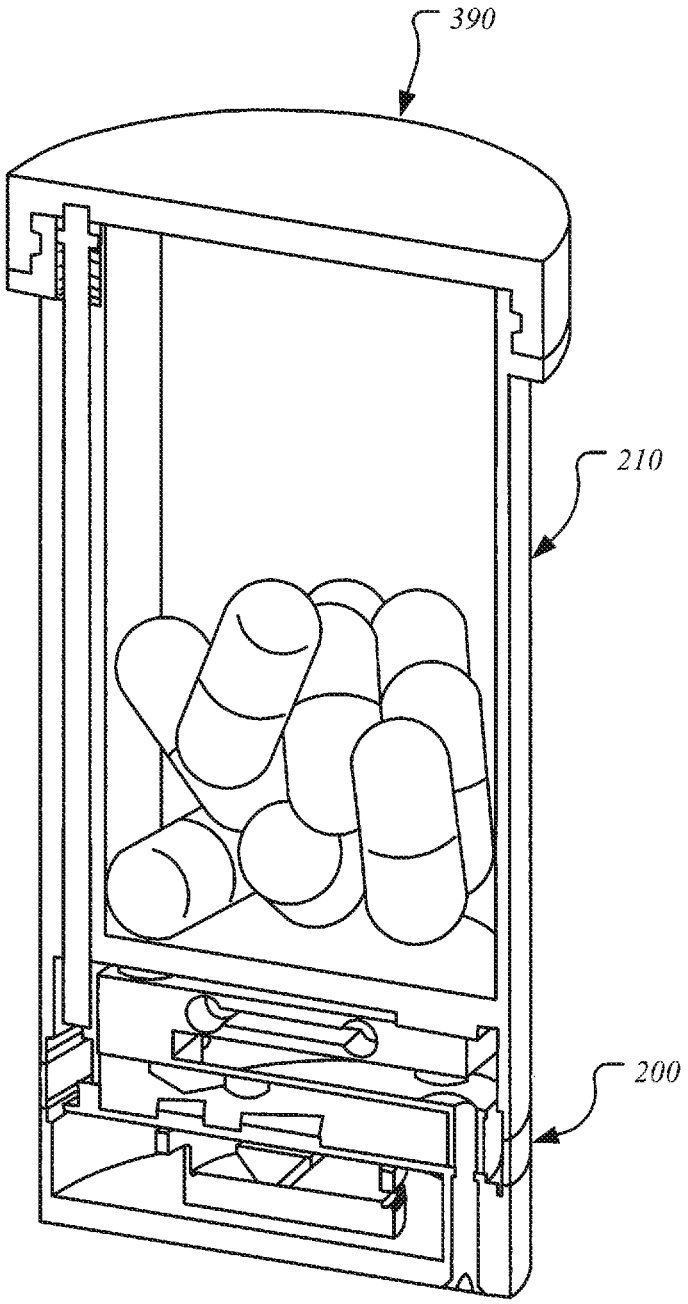
FIG. 6 is a cross-sectional view taken along section B-B in FIG. 5 (with lid on top of bottle and closed) of the present invention medicine bottle accessory located inside of the snap-on embodiment.
Figure 7:
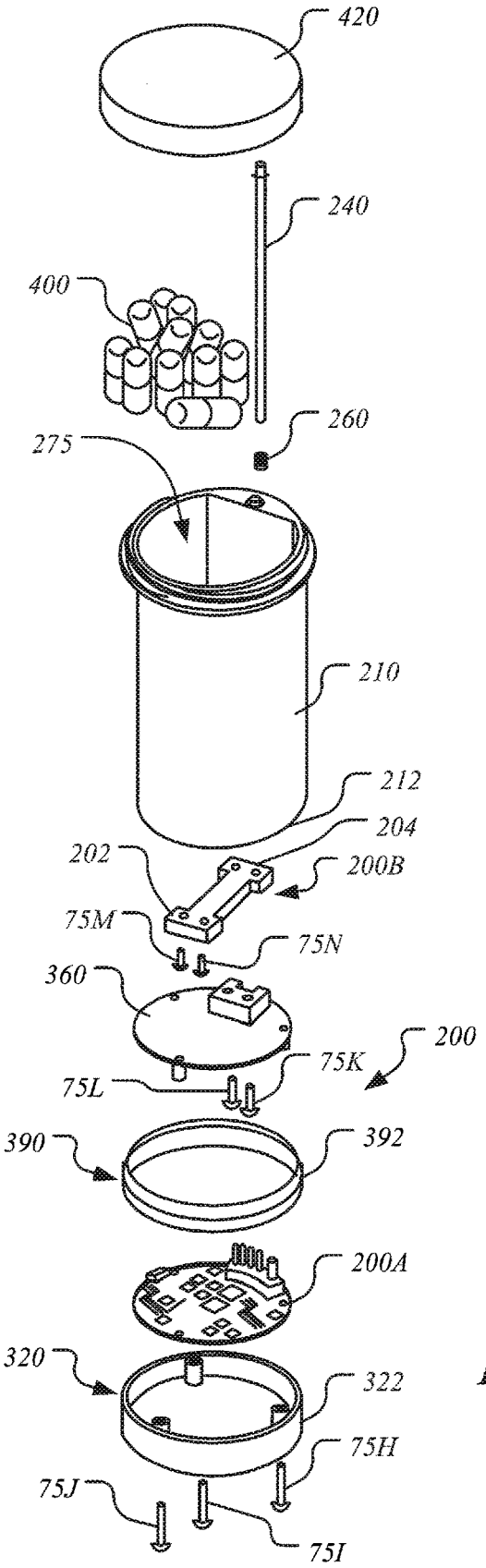
FIG. 7 is an exploded view of the present invention medicine bottle accessory located inside of the medicine bottle embodiment.

Referring to FIG. 6, there is illustrated a cross-sectional view of the second embodiment medicine bottle 210 taken along section line B-B of FIG. 5 (with the medicine bottle lid affixed) and also referring to FIG. 7, exposing the present invention pill bottle accessory 200 which is comprised of printed circuit board (PCB) section 200A and strain gauge section 200B, with PCB section 200A having a humidity sensor, a temperature sensor and a motion detection sensor.

Referring to FIG. 7, there is illustrated an exploded view of the present invention medicine bottle accessory 200 located inside of the medicine bottle 210 embodiment. The present invention medicine bottle accessory 200 is comprised of PCB 200A and string gauge 200B. Located underneath bottle sensor 250 and located within cylindrical cavity 270 is locking rod 240 and locking rod spring 260. When medicine bottle lid 420 is rotated open to access bottle cavity 275 containing pills 400, locking rod 240 is displaced by locking rod spring 260 triggering bottle sensor 250. This signal is then sent to the microcontroller 120 (see FIG. 4).

Further illustrated in FIG. 7, is printed circuit board (PCB) 200A which is located within the enclosure made between the connection of bottle base 320 and the informational ring 390. PCB 200A and informational ring 390 are retained together by the affixing of bottle base 320 to PCB support plate 360 by affixing screws 75H, 75I, and 75J. Directly above bottle base 320 is informational ring 390. Informational ring 390 works in conjunction with PCB section 200A and mechanical and electronic sensors are used to notify a user by bottle alert 392 when one of the pre-selected threshold criteria for temperature, humidity, motion, bottle opening, or notification data for scheduled dispensing of medicine has occurred.

Directly above PCB support plate 360 is strain gauge 200B. Strain gauge right end 204 is affixed to PCB support plate 360 by use of affixing screws 75K and 75L. On the opposite side of strain gauge 200B or strain gauge left end 202, affixing screws 75M and 75N affix strain gauge left end 202 to medicine bottle bottom 212 of medicine bottle 210.

Figure 8:
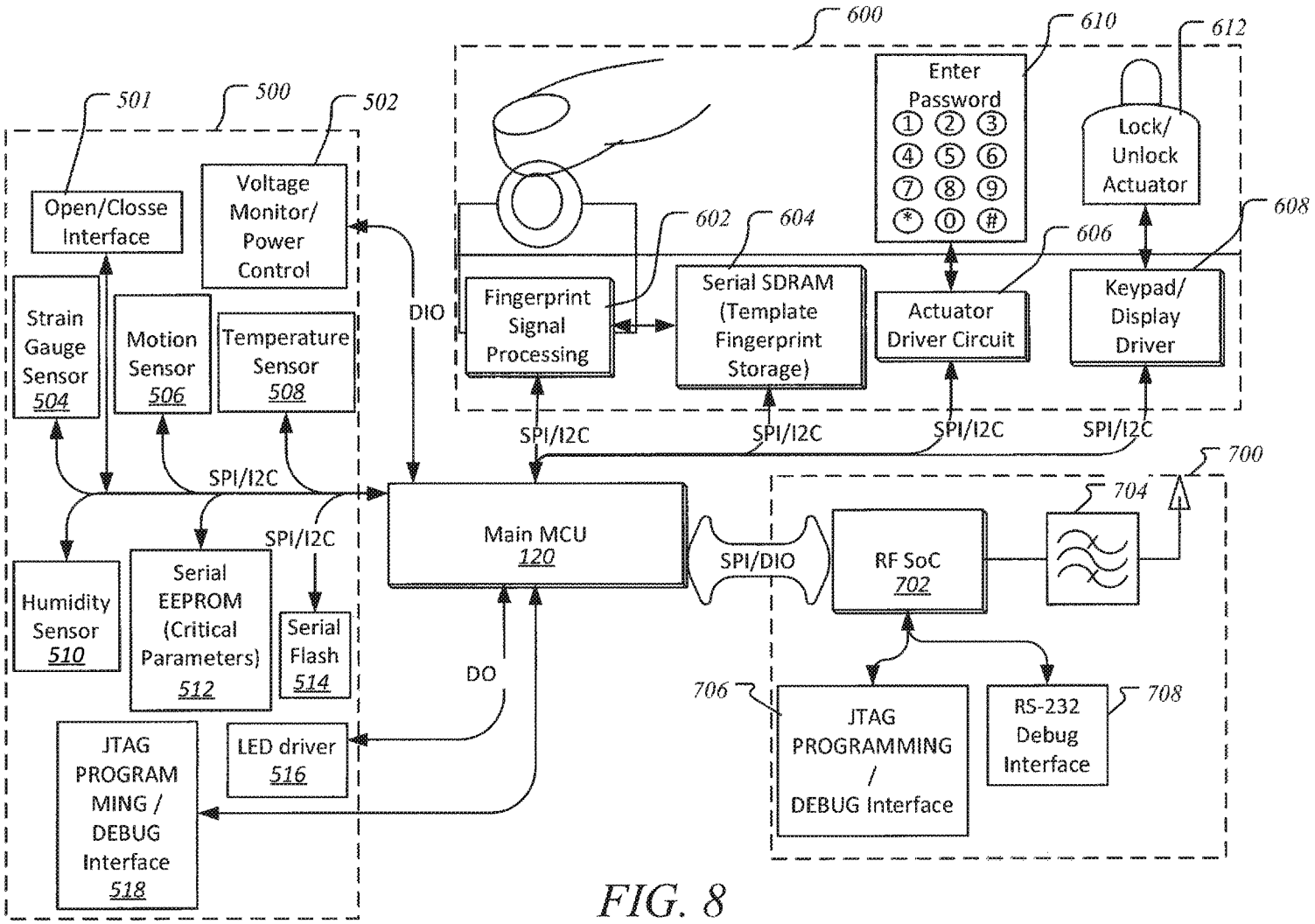
FIG. 8 is a schematic of the present invention illustrating the multipoint control unit (MCU) communicating with alert sensors, external devices, and a locking system (if used).

FIG. 8 contains a schematic of the present invention medicine bottle accessory 100 or medicine bottle accessory 200 depending upon which embodiment the invention is placed within. The medicine bottle accessory 200 has a PCB with sensor schematic 500, fingerprint schematic 600, external source connection schematic 700, and multipoint control unit (MCU)/microcontroller 120.

To the left of the microcontroller or main MCU 120 is sensor schematic 500 having an open/close interface 501, a voltage monitor/power control 502, a strain gauge sensor 504, a motion sensor 506, a temperature sensor 508, a humidity sensor 510, a serial EEPROM to store critical parameters 512, a serial flash 514, an LED driver 516, and a JTAG programming/debug interface 518. Each one of the sensors within sensor schematic 500 has a direct connection with MCU 120.

Further referring to FIG. 8 and above MCU 120, there is illustrated a fingerprint sensor schematic 600 having a fingerprint digital processing center 602, Serial SDRAM (Template fingerprint storage) 604, actuator driver circuit 606, keypad/display driver 608, password keyboard 610, and lock/unlock actuator 612.

To the right of MCU 120, there is an output sensor schematic 700 to enable MCU 120 to communicate with external devices or the internet. Output sensor schematic 700 has a RF Soc 702, External Connection 704, JTAG programming debug interface 706, and R8-232 Debug interface.

Further illustrated in FIG. 8, is a schematic of each of the sensors and their direct communication to MCU 120. MCU 120 will receive this sensor information and then communicate, based upon a user's desire to receive pre-programmed sensory thresholds, via RF Soc 702 to external devices 704. Between each strain gauge and MCU, there is an analog digital converter.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A medication bottle accessory having a medication management system, the medication bottle accessory comprising:

a. a printed circuit board having a microcontroller;

b. a temperature sensor to determine temperature, a humidity sensor to determine humidity, a motion detector sensor to determine movement of a medication bottle, an alert buzzer, and an alert LED light;

c. a wireless transceiver that allows communication with an external device;

d. said microcontroller used to interface with a multitude of electronic and mechanical sensors with said microcontroller having a current time and a multitude of pill distribution times;

e. said microcontroller having a direct connection with said humidity sensor and said temperature sensor;

f. said microcontroller having a direct connection with an analog digital converter and said analog digital converter having a direct connection to a strain gauge;

g. said microcontroller having a direct connection with said motion detector;

h. the medication bottle accessory is located within a snap-on structure, the snap-on structure including:

i. a disposable upper section, a middle cylindrical section, and a lower cylindrical section, ii. said disposable upper section having an upper first top surface, an upper second top surface, an upper outer circumferential surface, an upper transitional surface, an upper inner surface, and an upper interlocking section, iii. said middle section having a middle interlocking section a middle first outer circumferential surface and a middle second outer circumferential surface, iv. said lower section having a lower outer circumferential surface; and i. wherein said alert buzzer and said alert LED light are activated when at least one alert signal is activated, said alert signal selected from the group consisting of movement of the medication bottle, the temperature exceeds a preset threshold, the humidity exceeds a preset threshold, a distribution time occurs, and said strain gauge deflects;

j. wherein said microcontroller stores at least one notification data to be transmitted via said wireless transceiver to an external device;

k. wherein said snap-on structure is temporarily affixed to bottom surface of the medication bottle.

2. The medication bottle accessory in accordance with claim 1, further comprising: activation of alarm occurs when the bottle is opened, movement of the medication bottle; removing pills from bottle, or improper mixing of pills.

3. The medication bottle accessory in accordance with claim 1, further comprising: said current time updated by mobile application or computer that transmits current time service to the medication bottle accessory.

4. A medication bottle accessory having a medication management system, the medication bottle accessory comprising:

a. a printed circuit board having a microcontroller;

b. a temperature sensor to determine temperature, a humidity sensor to determine humidity, a motion detector sensor to determine movement of a medication bottle, an alert buzzer, and an alert LED light;

c. a wireless transceiver that allows communication with an external device;

d. said microcontroller used to interface with a multitude of electronic and mechanical sensors with said microcontroller having a current time and a multitude of pill distribution times;

e. said microcontroller having a direct connection with said humidity sensor and said temperature sensor;

f. said microcontroller having a direct connection with an analog digital converter and said analog digital converter having a direct connection to a strain gauge;

g. said microcontroller having a direct connection with said motion detector;

h. said printed circuit board containing said temperature sensor and said humidity sensor;

i. said alert LED light in direct communication with said printed circuit board with said alert LED light located external to said printed circuit board;

j. the medication bottle accessory is located within a snap-on structure with the snap-on structure having:

i. a disposable upper section, a middle section, and a lower section, ii. said disposable upper section having an upper first top surface, an upper second top surface, an upper outer circumferential surface, an upper transitional surface, an upper inner surface, and an upper interlocking section, iii. said middle section having a middle interlocking section a middle first outer circumferential surface and a middle second outer circumferential surface, iv. said lower section having a lower outer circumferential surface; and k. wherein said alert buzzer and said alert LED light are activated when at least one alert signal is activated, said alert signal selected from the group consisting of movement of the medication bottle, the temperature exceeds a preset threshold, the humidity exceeds a preset threshold, a distribution time occurs, and said strain gauge deflects;

l. wherein said microcontroller stores at least one notification data to be transmitted via said wireless transceiver to an external device;

m. wherein said snap-on structure is temporarily affixed to bottom surface of the medication bottle.

5. The medication bottle accessory in accordance with claim 4, further comprising: said current time updated by current time service.

6. The medication bottle accessory in accordance with claim 4, further comprising: activation of alarm occurs when the bottle is opened, movement of the medication bottle; removing pills from bottle, or improper mixing of pills.

* * * * *